United States Patent [19]

Dornier et al.

[11] Patent Number: 4,823,479

[45] Date of Patent: Apr. 25, 1989

[54] MATERIAL DRYER, ESPECIALLY FOR BULK MATERIAL TRAVELLING CONTINUOUSLY THROUGH THE DRYER

[75] Inventors: Peter Dornier; Rudolf Langer; Gerhard Troetscher; Anton Hecht, all of Lindau, Fed. Rep. of Germany

[73] Assignee: Lindauer Dornier Gesellschaft mbH, Lindau/Bodensee, Fed. Rep. of Germany

[21] Appl. No.: 49,700

[22] Filed: May 13, 1987

[30] Foreign Application Priority Data

May 20, 1986 [DE] Fed. Rep. of Germany ..... 3616966

[51] Int. Cl.[4] ..... F26B 17/02

[52] U.S. Cl. ..... 34/210; 34/85; 34/242

[58] Field of Search ..... 34/201, 205, 210, 242, 34/85, 213, 209

[56] References Cited

U.S. PATENT DOCUMENTS

| | | | |
|---|---|---|---|
| T883,023 | 2/1971 | Craven et al. | 34/85 |
| 2,758,386 | 8/1956 | Cobb | 34/213 |
| 2,937,454 | 5/1960 | Scott et al. | 34/213 |
| 3,007,690 | 11/1961 | Koniewie | 34/242 |
| 3,927,540 | 12/1975 | Tanaka | 34/242 |
| 4,133,718 | 1/1979 | Jaquay | 34/242 |
| 4,150,494 | 4/1979 | Rothchild | 34/242 |
| 4,253,417 | 3/1981 | Velentijn | 34/242 |
| 4,299,036 | 11/1981 | Schregenberger | 34/210 |
| 4,320,585 | 3/1982 | Duperret | 34/210 |
| 4,532,857 | 8/1985 | Sollich | 34/201 |

FOREIGN PATENT DOCUMENTS

| | | |
|---|---|---|
| 3240611 | 5/1983 | Fed. Rep. of Germany . |
| 3217830 | 11/1983 | Fed. Rep. of Germany . |
| 3414853 | 6/1984 | Fed. Rep. of Germany . |
| WO84/01207 | 3/1984 | PCT Int'l Appl. . |

*Primary Examiner*—Henry A. Bennet

*Attorney, Agent, or Firm*—W. G. Fasse; D. H. Kane, Jr.

[57] ABSTRACT

A material dryer, especially for bulk material, includes a single entrance pressurized drum housing and an endless conveyor for passing the material through the drum housing. The conveyor may include a screen belt. The housing and the dryer components in the housing are divided into identical modular units, except for the entrance and discharge units. Each modular unit includes a tubular housing section, a conveyor section, and a treatment medium handling section for circulating and heating the drying medium such as super-heated steam. The heating and circulating of the treatment medium is individually controllable in each modular unit. The entrance unit is equipped with conveyor belt guides and with a sealed material supply device. The discharge unit is equipped with a belt drive and with a sealed material discharge device.

14 Claims, 3 Drawing Sheets

MATERIAL DRYER, ESPECIALLY FOR BULK MATERIAL TRAVELLING CONTINUOUSLY THROUGH THE DRYER

THE INVENTION

The invention relates to a dryer, especially for bulk material travelling on a continuous path through the dryer. The path conveying the material through the dryer is particularly a gas permeable conveyor belt, especially an endless conveyor belt for transporting the bulk material. A housing forms a gas-tight closed drying channel with an inlet end and an outlet end for the supply and discharge of the bulk material respectively.

DESCRIPTION OF THE PRIOR ART

Different methods are known for the drying of materials such as bulk materials. For example, radiation drying, contact drying, or convection drying have all been employed heretofore. The purpose of these drying methods is to withdraw moisture from different types of materials and to bring the materials into a condition suitable for further use or processing. By supplying heat with the aid of a heat carrier to the material, moisture is withdrawn from the material in the form of a vaporization, whereby the vapors must be removed from the drying apparatus. In most conventional methods or systems air or another gaseous medium is used as the heat carrier which is simultaneously functioning as the conveying vehicle for the evaporated liquid.

German Patent Publication (DE-OS) No. 3,414,853 discloses a bulk dryer for the continuous drying of bulk material in which a so-called belt dryer is employed, comprising a plurality of transport belts arranged at several levels, one above the other. The material to be dried is supplied to the top most belt and then the material passes sequentially from one higher belt to a lower belt and so forth until it is discharged from the lowest belt in the lowest level. A so-called belt chamber is located at each level above the respective conveyor belt. Heated air is used as the heat carrier and blown out of the so-called belt chamber onto the air permeable conveyor belt provided, for example, in the form of a screen belt on which the material to be dried is transported while the air is blown onto the material. The belt chambers at all levels are interconnected through wall passages with a common pressurized chamber, whereby heat exchangers are located in said wall passages for heating the drying air. The air circulation or conveying is accomplished by a plurality of fans or blowers which pass the air prior to its exit, from the pressure chamber through air filters.

The just mentioned prior art system has a special disadvantage in that the entire heated air used for the drying is discharged into the atmosphere since the drying air contains a high degree of humidity. As a result, it is necessary to continuously draw fresh air into the system and that fresh air needs to be heated which entails a substantial, high energy requirement. Further, the moisture removal from the material does not take place efficiently because on the one hand the degree of humidity in the material decreases from level to level downwardly, while on the other hand uniformly heated air is blown out of the band chambers onto the material. In other words, it is not possible to optimally adapt the heat supply to the respectively applicable degree of moisture which varies from belt to belt.

German Patent Publication (DE-OS) No. 3,217,830 discloses an apparatus for drying continuous webs of material. This known apparatus operates more efficiently as far as energy requirements are concerned and as compared to the bulk material dryer of German Patent Publication No. 3,414,853. The underlying teaching of the system according to German Patent Publication No. 3,217,830 takes into account that during the entire treatment of the advancing material webs a gaseous or vaporous treatment medium is repeatedly blown onto the material web and that after each treatment operation, the drying medium is again removed from the material web. German Patent Publication No. 3,217,830 recognizes that a drying medium which contacted already partially dried zones of the web to be dried, has taken up small quantities of moisture and therefore is capable of taking up further moisture. However, such further moisture is not available from zones of the web material which have progressed substantially through the drying procedure. Thus, this prior art reference improves the efficiency of the energy use of the drying device in that a drying medium coming from zones where the drying has progressed to a substantial extent, is used for a further heat treatment, for example, for a predrying of the material web. Only after such additional use of the drying medium will the latter be either discharged from the total treatment operation, or it is preheated prior to its application to material web zones which are still rather moist. For this purpose the prior art apparatus is equipped with a special preliminary drying zone located in the rear portion of the dryer. The treatment medium available at the rear portion of the dryer is used for the preliminary drying prior to the discharge of the drying medium. The material web to be dried is passed through the preliminary drying zone prior to being moved into the main drying zone.

Although the dryer according to German Patent Publication No. 3,217,830 utilizes the treatment medium twice, and thus achieves an improved energy efficiency, the prior art system has the disadvantage that the arrangement of a special predrying zone at one end of the dryer requires a special guiding of the material web from the preliminary drying zone through a detour back to the inlet of the main drying zone at the other end of the entire apparatus. This guiding of the material web requires a substantial structural effort and expense. Besides, such special guiding of the material web does not improve the material quality. A further disadvantage is seen in the fact that overall there is no adaptation of the heat supply to the moisture degree of the material web at any particular point along its travel path.

German Patent Publication (DE-OS) No. 3,240,611 describes a further drying apparatus for continuous material webs. In this conventional apparatus the material web and a heating medium are passed simultaneously through a drying channel, whereby the material web is heated and whereby the heating medium carries off the liquid evaporated out of the material web. The apparatus operates with recirculating air which means that a portion of the heating medium that has taken up evaporated liquid is discharged and replaced by fresh air. The discharge portion is again heated by an external heat supply, whereupon the reheated medium is returned into the drying medium circulating system. The system of German Patent Publication No. 3,240,611 avoids using air as the heating medium because air requires a substantial external energy input. Instead the known system uses super-heated steam as the heating medium. The super-heated steam exiting from the drying channel carries a steam proportion which has been withdrawn from the material web. Only this added steam proportion is discharged as waste steam while the remaining proportion of the drying medium is reheated and thereafter returned into the drying channel. The apparatus for performing this prior art method has a substantially gas-tight drying channel in which the material web entrance and the material web discharge are formed by a respective gas-tight sluice.

The treatment of the material web takes place in the apparatus of German Patent Publication No. 3,240,611 in a single stage. Thus, by using super-heated steam the energy efficiency can be improved. However, a suitable adaptation of the heat supply to the degree of moisture content at any particular location within the drying channel is not possible. This type of apparatus is, for example, not suitable for use in long drying channels which are required for drying bulk material.

In all prior art dryers it is not possible to adapt the regenerated circulating air, which has been heated and filtered, to the evaporating rate which changes along the drying channel. Thus, in all prior art dryers the energy efficiency is not optimal.

OBJECTS OF THE INVENTION

In view of the foregoing it is the aim of the invention to achieve the following objects singly or in combination:

to optimally reduce the energy requirements for a dryer having a continuous material supply belt type conveyor, especially one with a gas permeable conveyor belt;

to construct a dryer of the type mentioned in such a way that independently of the length of the drying channel the heat supply is optimally adapted to the moisture degree prevailing in different zones along the drying path;

to divide the drying apparatus into a plurality of modular units which are individually controllable and which may be assembled to form drying channels substantially of any desired length; and to provide a drying apparatus which is suitable or easily adaptable to many different materials, particularly bulk materials.

SUMMARY OF THE INVENTION

The drying apparatus, or rather, the drying channel according to the invention, is constructed of a plurality of modular units of the same kind. Each unit is fully functional and individually controllable. All the units are arranged at a single level and an endless preferably gas permeable conveying system passes through all units. Each unit is further equipped with means for regenerating the treatment medium which is preferably super-heated steam. These regenerating means comprise, e.g., heaters and pumps for circulating the treatment medium. The inlet and outlet zones of the apparatus are equipped with guide members and drive means for the conveyor that transports the material to be dried through the drying channel. The inlet zone is further equipped with a feed-in device such as a screw conveyor for supplying the bulk material to be dried in a gas-tight or gas sealing manner into the drying channel. Similarly the discharge end of the drying apparatus is equipped with dried material discharge devices° such as screw conveyors which also seal the discharge end in a gas-tight manner.

Advantages of the invention are seen in that the energy requirements are substantially more economical than heretofore. Additionally, the modular construction of the drying channel has several advantages, such as easier transport, adaptation of the drying channel to different purposes, and the selection of the proper drying channel length in accordance with the requirements of the material to be dried. In other words, each material can now have a dryer length that is optimal with regard to the characteristics of the particular material. The individual control of each drying unit, especially the control of the heating of the treatment medium, makes it possible to efficiently adapt the heat input to the moisture content prevailing in the particular zone. Additionally, due to the single level construction, it is now possible to select the proper size or rather power output of the individual heating members for the quantity of water vapor that is to be expected in any particular drying zone. Similarly, the power output of the circulating blowers can now be selected in accordance with the localized requirements. These features substantially reduce the manufacturing cost because the heaters, for example, and the blowers at the end of the drying channel may be substantially smaller than those at the beginning of the drying channel. Further, the size of the surface area required for the heat exchange in the regeneration of the treatment medium in the heating devices can now be adapted to the localized heat requirement, for example, by adding sections of a heating unit into the system or by switching off such sections. Similarly, each channel unit can now be equipped with several circulating blowers which may be individually adapted in their power outputs to the moisture degree prevailing at any particular point within the drying units. Instead of relying on the moisture content for the control of the heat input and blower output, the evaporation quantities can be used as control values. The just mentioned control possibilities are also available for a dryer that is already installed so that such dryers can be easily adapted, for example, for the treatment of another type of material having different moisture degrees and different characteristics such as the granularity, for example.

BRIEF DESCRIPTION OF THE DRAWINGS

In order that the invention may be clearly understood, it will now be described, by way of example, with reference to the accompanying drawings, wherein.

DETAILED DESCRIPTION 0 PREFERRED EXAMPLE EMBODIMENTS AND OF THE BEST MODE OF THE INVENTION

Figure 1A:
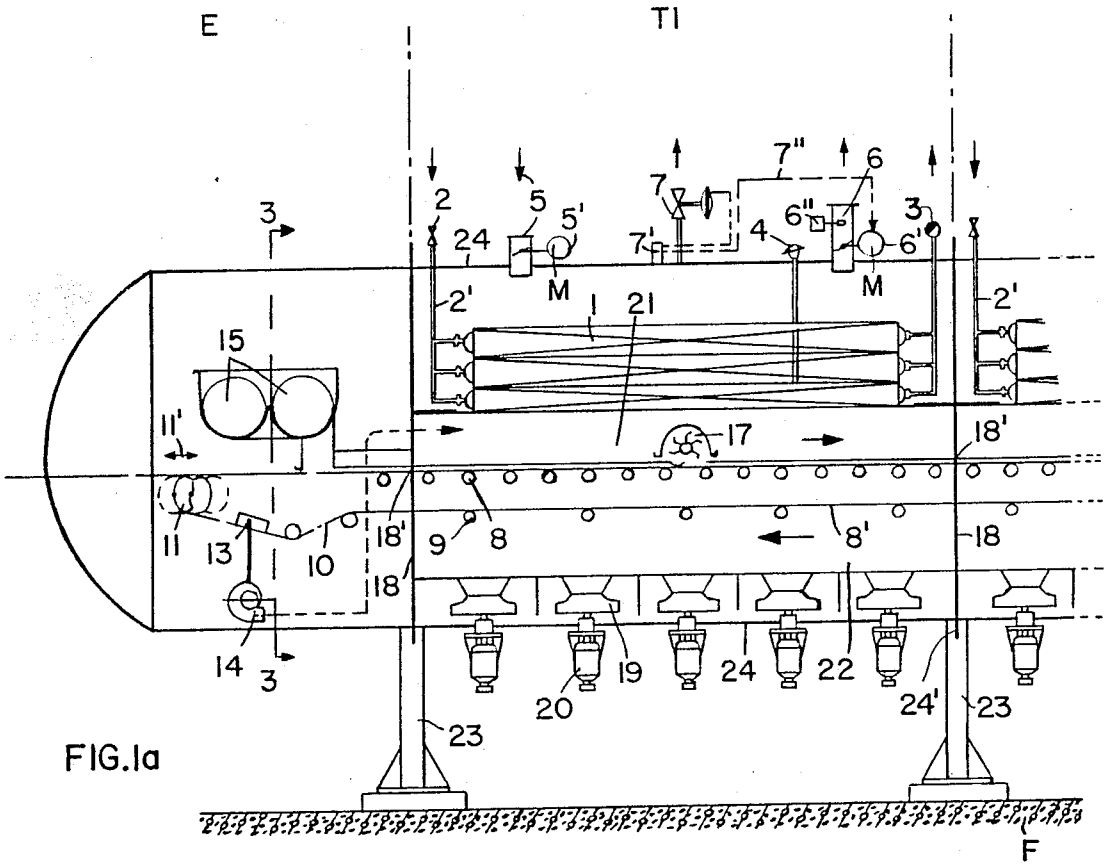
FIGS. 1*a* and 1*b* illustrate together a longitudinal section through a dryer according to the invention.
Figure 1B:
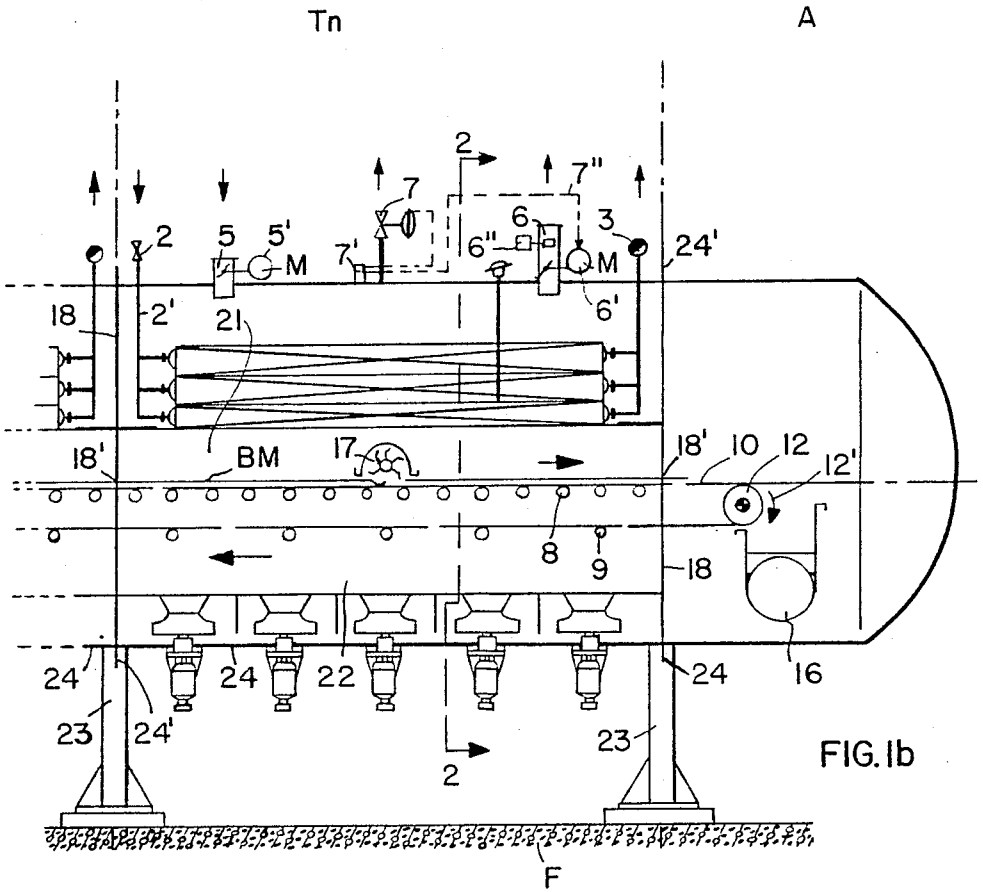

The sectional view of FIGS. 1*a* and 1*b* shows the internal construction of the present dryer comprising a self-contained entrance or inlet unit E, a plurality of modular self-contained drying units T1, T2 . . . to Tn, and a self-contained discharge or exit unit A. Practical embodiments comprise, for example, seven or eight modular drying units. However, the number of drying units as such is not critical and may be selected in accordance with individual requirements. Since the individual modular drying units are identical to each other, only the first and last units are shown.

All individual self-contained drying modular units Tl to Tn are constructed as cylindrical tubular sections 24 forming part of the entire stationary dryer housing. Neighboring tubular sections 24 are interconnected to each other, for example, by nuts and bolts extending through conventional flanges 24' extending radially outwardly and preferably holding a seal between two flanges for a pressure-tight seal of the entire channel. If desired, neighboring modular units 24 may be further separated by bulk heads 18 forming separating walls between adjacent units. Each bulk head or separation wall 18 is provided with a passageway 18' for the passing of the endless conveyor belt 8' which is preferably permeable to the gaseous or vaporous drying medium. The passageways 18' are of just sufficient size to permit the bulk material BM resting on the conveyor belt 8' to pass through the passageway together with the belt 8'. Thus, the individual dryer channel units are substantially pressure sealed from one another by the bulk material BM.

Each modular drying unit is equipped with all the components required for the proper functioning of the dryer thereby permitting an individual control. Each modular unit 24 encloses a space 21 which is equipped as will now be described The conveyor belt 8' with its upper support rollers 8 and its lower support rollers 9 forms a conveying system 10, one end of which comprises guide rollers 11 and the other end of which is equipped with drive members 12. The motor for rotating the drive members 12 such as rollers, is not shown since it is conventional. The rollers rotate in the direction of the arrow 12'. The guide rollers 11 may be adjustable in their horizontal position as indicated by the double arrow 11' for tightening the endless belt 8'. The belt 8' may be made of a screen material to achieve the mentioned permeability. The bulk material BM resting and travelling on the upper run of the belt 8' may, for example, be sugar beet cossettes to be dried. Each modular drying unit 24 is also equipped with at least one material turning member 17 such as a paddle wheel or the like which loosens up or fluffs up the bulk material to improve the contact of the individual bulk material elements with the drying medium.

As shown in FIGS. 1*a* and 1*b*, the self-contained entrance or inlet unit inlet end E of the dryer is also separated from the first modular unit Tl by a bulk head or separation wall 18 with its passageway 18'. Similarly, the discharge end A is separated from the last modular unit Tn by a separating bulk head 18 with its passageway 18'. The entire dryer is a pressurized container in which the excess pressure relative to the atmosphere is, for example, 0.5 bar. However, due to the described bulk head or separation walls 18 with the passageways 18' which are substantially pressure sealed by the bulk material itself, it is possible to maintain different pressures within the volumes 21 of each individual modular unit 24. Due to the excess pressure inside the modular units, it is necessary to seal the self-contained inlet unit E and the self-contained outlet zone A from their respective neighboring modular units. Such seal can be adequately accomplished by screw conveyors 15 filled with the wet bulk material at the inlet end and by screw conveyors 16 filled with dried bulk material at the discharge end. The screw conveyor 15 is equipped, for example, with double screws and extends in a direction perpendicularly to the travel direction of the conveyor belt 8' and thus perpendicularly to the plane of the sheet of the drawing showing FIG. 1*a*. Similarly, the single screw conveyor 16 also extends perpendicularly to the plane of the drawing.

Figure 2:
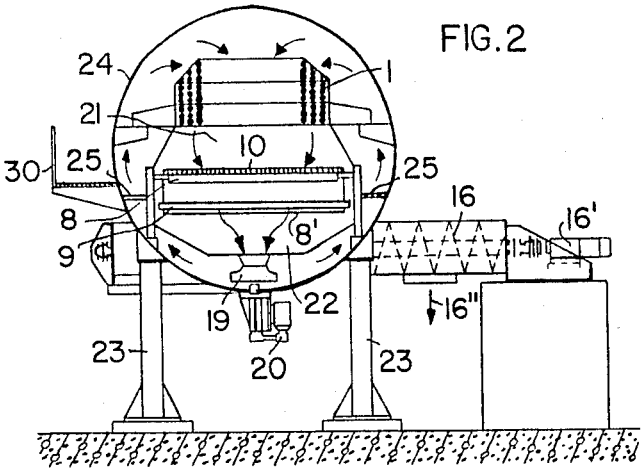
FIG. 2 is a sectional view through one modular unit along section line 2—2 in FIG. 16, whereby the view is directed toward the end of the drying apparatus.
Figure 3:
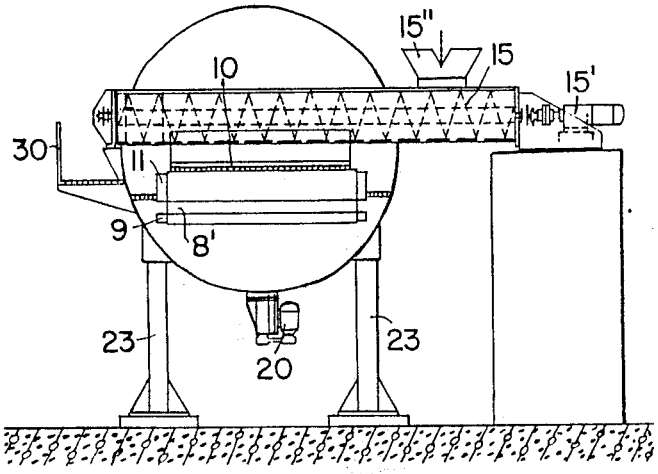
FIG. 3 is a sectional view through the inlet end of the present drying apparatus along section line 3—3 in FIG. 1*a*.

Referring to FIG. 3, a drive mechanism 15' drives the screw 15 of the screw conveyor to supply the bulk material onto the conveyor belt 8' of the conveyor system 10. The bulk material is fed into a hopper 15'' by conventional means as indicated by the arrow. Similarly, as shown in FIG. 2, the discharge conveyor 16 is driven by a drive mechanism 16' and the dried bulk material is discharged downwardly as indicated by the arrow 16''.

Referring again to FIG. 1*a* and 1*b*, a cleaning mechanism 13 is arranged in the inlet zone E for cleaning the conveyor belt 8'. The cleaning mechanism may, for example, comprise a known brush set combined with a suction device 14 for blowing the removed bulk material elements or particles back onto the upper run of the conveyor 8', as indicated by the dashed line arrow in FIG. 1*a*.

As shown in FIG. 2, the pressurized internal space 21 inside each modular drying unit is formed above the conveying belt 8' and below the respective heating device 1. Below the conveyor belt 8' a suction space is formed which leads into a fan or blower 19 for maintaining a closed circuit flow of the treatment medium through the pressurized space 21, through the permeable screen belt 8', and thus through the bulk material BM back into the suction space 22 and through the blower 19, whereby the outlet of the blower 19 blows the treatment medium against the circular inner wall surfaces to guide the treatment medium as indicated by the dark arrows in a circular flow. Thus, the circular flow is forced to pass through the regenerating means for the treatment medium. These regenerating means include the heater 1 and, if desired, a filter device that may be located at 25 on a screen bottom or the like. A gangway 30 as seen in FIGS. 2 and 3 is arranged alongside the dryer housing for maintenance purposes.

As further shown in FIGS. 1*a* and 1*b*, the individual dryer units are mounted on conventional footings 23 secured to the floor F as is conventional. However, according to the invention the footings 23 are horizontally spaced from each other by spacings corresponding to the standardized axial length of the respective modular drying unit Tl to Tn.

Each blower 19 is equipped with its own motor 20 which may, for example, be a fluid operated motor. Preferably, the motors 20 are secured to the cylindrical wall of each unit 24 on the outside thereof and the power input passes through a respective seal in the wall of each unit 24. However, the drive motors 20 may also be located inside the housing formed by the cylindrical walls of the units 24.

Referring to FIG. 1*a* and 1*b*, the heating medium such as super-heated steam, is supplied through a valve 2 individually into each drying unit 24. The valve 2 leads through a duct 2' to the heating unit 1 which may comprise, for example, three individual sections, each of which is separately controllable just as each of the motors 20 is separately controllable. Thus, the quantity of circulating drying medium may be controlled through the motors 20. Similarly, the heat quantity may be controlled through a temperature sensor 4. The individual sections of the heater 1 may be switched on or off to provide the proper heat exchange surface area for any particular requirements. The heating medium that has passed through the heater or heat exchanger 1 is discharged through an outlet 3. The switching on and off of the individual heating sections of the heat exchanger 1 may also be accomplished manually, for example, through valves externally accessible. Drying medium, such as super-heated steam, is supplied through inlet ports 5 provided with a valving mechanism that may be driven by a respective motor 5'. The discharge of excess treatment medium takes place through an outlet 6 which is also valve controlled through a motor 6'. A sensor 6" ascertains the degree of humidity in the drying medium being discharged through the outlet 6. A pressure sensor 7' controls a valve 7 for individually regulating the pressure inside each modular drying unit 24. The pressure inside the individual modular drying units 24 may also be used for controlling the motor 6' as indicated by the dashed line 7" for opening the valve or flap in the discharge outlet 6 more or less as required for maintaining a desired excess pressure in the modular drying units 24.

In the light of the foregoing description it is clear that each of the modular drying units 24 is individually controllable in accordance with the particular requirements prevailing in the respective drying unit. The control values may be based on experience ratings and may include the degree of moisture in the bulk material as a function of the progressive drying as the material passes from left to right through the dryer. Such moisture values may be ascertained by way of tests and assembled in the form of tables or curves for use as the control inputs, either for a manual control or for an automatic control of the required blower output of the fans 19 and of the heat output of the heat exchangers 1. Thus, it is possible to adjust each drying unit prior to start-up in accordance with such tables or curves and in accordance with the particular type of bulk material to be dried.

However, it is also possible to provide for a continuous regulation and control of the apparatus during its operation in response to continuously measured values, such as temperature values, moisture values, and possibly also pressure values for adjusting an optimal drying process characteristic. Even a completely automatic optimal control of the individual drying units is possible as a function of the respective measured values. In any event, the aim should be that through the outlets 6 only that moisture content is discharged to the atmosphere which is generated in the particular drying units by the evaporation of the liquid in the bulk material. As a result of these features it is always possible to perform the drying in each individual unit with the least possible energy input.

If desired, it is also possible to apply common controls to two or more modular drying units as far as the regenerating devices, such as the heaters are concerned, which thus may be connected to a common control such as a closed loop control. Due to this individualized control, the heat quantity applied will always correspond to that needed for removing the measured moisture content. Thus, the above mentioned difficulties with multi-level dryers have been avoided.

Further, the installation of new dryer systems has been greatly facilitated by the modular type of construction because the invention now makes it possible to provide dryers of any desired length.

Although the invention has been described with reference to specific example embodiments, it will be appreciated that it is intended to cover all modifications and equivalents within the scope of the appended claims.

What we claim is:

1. A material dryer, comprising dryer means including a self contained entrance unit, a plurality of self-contained intermediate units, and a self-contained discharge unit, said units forming stationary housing means for enclosing a pressurized drying space, endless belt type conveyor means operatively supported in said stationary housing means for transporting said material through said dryer, treatment means operatively arranged in said intermediate units of said dryer means for circulating and regenerating a drying medium in said housing means, each of said intermediate units of said dryer means being constructed as a fully functional, individually controllable modular unit comprising a stationary housing section of said stationary housing means, a section of said endless belt type conveyor means, treatment medium circulating means as part of said treatment means for applying treatment medium to said material, treatment medium regenerating means as part of said treatment means for individually regenerating the dried in accordance with drying conditions individually controllable in each modular unit, said self-contained entrance and discharge units comprising guide means for said endless belt type conveyor means, pressure-tight material feed-in means (15) located in said self-contained entrance unit for feeding material to be dried into said dryer, drive means for said endless belt type conveyor means, and pressure-tight material discharge means (16) located in said self-contained discharge unit for removing dried material from said dryer, said dryer further comprising means for interconnecting said modular units in a pressure-tight manner, whereby a stationary drying channel of any desired length may be formed by interconnecting a required number of modular intermediate units between said entrance unit and said discharge unit, and means, said fluffing-up means being located in at least one of said modular drying units above the belt type conveyor means.

2. The dryer of claim 1, further comprising bulkheads with passageways for said endless belt type conveyor means, arranged between neighboring intermediate units.

3. The dryer of claim 1, wherein said modular drying units are constructed as stationary cylindrical sections, wherein the conveying means are arranged approximately in a horizontal central plane of said stationary housing means, wherein said regenerating means comprise heating means provided above said conveying means to form a closed pressurized space between the top of the conveyor means and the bottom of the heating means, wherein said treatment medium circulating means are arranged below the conveying means to provide a suction space for the treatment medium, and wherein the circulating flow of the treatment medium passes along inner surfaces of said cylindrical sections for returning treatment medium to the heating means.

4. The dryer of claim 3, wherein said circulating means comprise blower means arranged on the inside of said housing means, said blower means comprising drive means arranged outside of said housing means.

5. The dryer of claim 3, wherein said treatment medium circulating means comprise a plurality of blowers arranged in said modular drying units.

6. The dryer of claim 5, further comprising moisture content measuring means for providing a value representing the moisture of the material being dried for controlling a throughput quantity of the treatment medium through said blower means in response to the moisture content value so that the treatment medium throughput corresponds to an expected evaporation quantity.

7. The dryer of claim 1, wherein said heater means comprise a plurality of sections which can be switched on and off to provide an effective heat exchange surface area required for an intended heat exchange.

8. The dryer of claim 1, wherein said pressure-tight material feed-in means (15) in said self-contained entrance unit and said pressure tight material discharge means (16) in said self-contained discharge unit comprise material supply sealed screw converyors (means) and material discharge sealed screw conveyors (means) arranged perpendicularly to the feed advance direction of said belt type conveyor means, said (material supply means and said material discharge means comprising) sealed screw conveyors (15, 16) passing through a housing wall of the respective entrance unit and of the respective discharge unit.

9. The dryer of claim 1, wherein said regenerating means comprise heating units located in several sequentially arranged modular drying units, said heating units being controllable in unison in a closed loop circuit.

10. The dryer of claim 1, further comprising cleaning means for cleaning a return run of said belt type conveyor means , said cleaning means comprising brush means (13) and a suction device (14) arranged for cooperation with said brush means for blowing removed material back onto for cleaning a return run of said conveyor means.

11. The dryer of claim I, further comprising hydraulic motor means arranged inside said housing means for driving rotation components.

12. The dryer of claim 1, further comprising means for individually supplying super-heated steam as a treatment medium into said modular drying units.

13. The dryer of claim 1, further comprising individually controllable treatment medium discharge means (6, 7) connected to said modular drying units.

14. A material dryer, comprising dryer means including a self-contained entrance unit, a plurality of self-contained intermediate units, and a self-contained discharge unit, said units forming stationary housing means for enclosing a pressurized drying space, endless belt type conveyor means operatively supported in said stationary housing means for transporting said material through said dryer, treatment means operatively arranged in said intermediate units of said dryer means for circulating and regenerating a drying medium in said housing means, each of said intermediate units of said dryer means being constructed as fully functional, individually controllable modular unit comprising a stationary housing section of said stationary housing means, a section of said endless belt type conveyor means, treatment medium circulating means as part of said treatment means for applying treatment medium to said material, treatment medium regenerating means as part of said treatment means for individually regenerating the treatment medium in each modular unit, whereby said material is dried in accordance with drying conditions individually controllable in each modular unit, said self-contained entrance and discharge units comprising guide means for said endless belt type conveyor means, pressure tight material feed-in means (I5) located in said self-contained entrance unit for feeding material to be dried into said dryer, drive means for said endless belt type conveyor means, and pressure-tight material discharge means (16) located in said self-contained discharge unit for removing dried material from said dryer, said dryer further comprising means for interconnecting said modular units in pressure-tight manner, whereby a stationary drying channel of any desired length may be formed by interconnecting a required number of modular intermediate units between said entrance unit and said discharge unit, and wherein said pressure-tight material feed-in means (15) in said self-contained entrance unit and said pressure-tight material discharge means (16) in said self-contained discharge unit comprise material supply sealed screw conveyors and material discharge sealed screw conveyors arranged perpendicularly to the feed advance direction of said belt type conveyor means, said sealed screw conveyors (15, I6) passing through a housing wall of the respective entrance unit and of the respective discharge unit.

* * * * *

UNITED STATES PATENT AND TRADEMARK OFFICE

CERTIFICATE OF CORRECTION

PATENT NO. : 4,823,479

DATED : April 25, 1989

INVENTOR(S) : Peter Dornier, Rudolf Langer; Gerhard Troetscher; Anton Hecht

It is certified that error appears in the above-identified patent and that said Letters Patent is hereby corrected as shown below:

Claim 1, line 27, before "dried" insert --treatment medium in each
(Col. 8) modular unit, whereby said material is--;

line 42, before "means" insert --means for fluffing-up material to be dried on said belt-type conveyor--.

Claim 8, line 20, delete "(means)";
(Col. 9) line 21, delete "(means)";
line 23, delete "(material supply";
line 24, delete "means and said material discharge means comprising)".

Claim 10, line 37, replace "for cleaning a return run of said conveyor
(Col. 9) means." by --the upper run of said belt type conveyor means.--.

Claim 11, line 39, replace "I" by --1--;
(Col.9) line 41, replace "rotation" by --rotating--.

Claim 14, line 12, after "as" insert --a--;
(Col.10) line 25, replace "(I5)" by --(15)--;
line 32, after "in" insert --a--;
line 44, replace "(15, I6)" by --(15, 16)--.

Signed and Sealed this

Seventh Day of November, 1989

*Attest:*

JEFFREY M. SAMUELS

*Attesting Officer* *Acting Commissioner of Patents and Trademarks*